United States Patent [19]

Gamacher

[11] 4,129,391

[45] Dec. 12, 1978

[54] INTEGRAL APPLICATOR STRUCTURE

[76] Inventor: Robert J. Gamacher, 33185 W. Warren, Westland, Mich. 48135

[21] Appl. No.: 543,427

[22] Filed: Jan. 23, 1975

[51] Int. Cl.[2] ..... B05C 17/00; B43M 11/02; B44D 3/28

[52] U.S. Cl. ..... 401/208

[58] Field of Search ..... 401/208, 218; 118/258, 118/259

[56] References Cited

U.S. PATENT DOCUMENTS

| | | | |
|---|---|---|---|
| 2,582,861 | 1/1952 | Coombs | 401/208 |
| 2,892,202 | 6/1959 | Williams | 401/208 |
| 2,957,191 | 10/1960 | Harris | 401/208 |
| 3,134,131 | 5/1964 | Thomas | 401/208 |
| 3,259,935 | 7/1966 | Miller | 401/208 |
| 3,263,265 | 8/1966 | Judson | 401/208 X |
| 3,848,565 | 11/1974 | Schweppe | 118/259 X |

*Primary Examiner*—Stephen C. Pellegrino
*Attorney, Agent, or Firm*—Whittemore, Hulbert & Belknap

[57] ABSTRACT

A cosmetic applicator including a container having a cosmetic containing chamber therein and an elongated slot in one side thereof, a roller comprising a foam rubber cylinder sleeved on a rigid core rotatably mounted on the container in the slot so as to extend radially therefrom, which roller has substantially the same, but slightly larger radial and longitudinal dimensions than the width and length of the slot, and partitions and a metering channel between the container chamber and the roller for guiding the cosmetic onto the roller for application to a body part, and a cover adapted to fit over the slot in the container with the roller mounted on the container.

12 Claims, 5 Drawing Figures

INTEGRAL APPLICATOR STRUCTURE

BACKGROUND OF THE INVENTION

1. Field of the Invention

The invention relates to applicators for cosmetics and refers more specifically to an integral applicator and container for suntan lotion or like cosmetic in which a roller is rotatably mounted in a slot in the side of a container, which roller is compressible and dimensioned to be slightly larger than the slot in the container whereby the lotion may be applied to a body part by holding the integral applicator structure in an inverted position, with the roller frictionally engaging a body portion and moving the applicator across the body portion to rotate the roller.

2. Description of the Prior Art

In the past, cosmetic applicators have taken a variety of forms such as puffs for powder, pumps for providing a small supply of lotion on demand, aerosol containers for blowing a dispersed cosmetic onto a body portion, and structure for forcing a substance such as toothpaste onto a toothbrush or shaving cream onto a shaving brush or the like for application to body portions.

In many of these devices the applicator is separate from the container for the cosmetic being applied and is consequently sometimes not readily available when it is desired to apply the cosmetic. Further, applicators of the past have often been complicated and therefore uneconomical to produce and often inefficient in use.

Hand application of many cosmetics is undesirable. Thus, for example, in the case of suntan lotion being used at a beach, the lotion is often mixed with sand on the hand of the person applying the lotion so that the suntan lotion is often applied with some abrasion to the body portion to which it is being applied.

SUMMARY OF THE INVENTION

The integral applicator structure of the invention includes a container having a chamber for a supply of suntan lotion or the like and an elongated slot in one side thereof, a roller rotatably mounted on the container in the slot so as to extend the full width and length thereof and to extend radially outwardly therefrom, and partitions between the roller and material in the chamber for directing the material over the greater portion of the surface of the roller as the roller is rotated.

The roller in accordance with the invention is constructed of a relatively rigid core and a compressible hollow cylinder sleeved over the core, which hollow cylinder has substantially the same but slightly longer length and width dimensions than the slot. The container is constructed of a relatively flexible plastic material surrounding the lotion supply and a relatively rigid plastic material adjacent the slot for rotatably mounting the roller.

A cover is provided for the container adapted to be releasably secured to the container over the roller installed on the container in the slot.

DESCRIPTION OF THE PREFERRED EMBODIMENT

Figure 3:
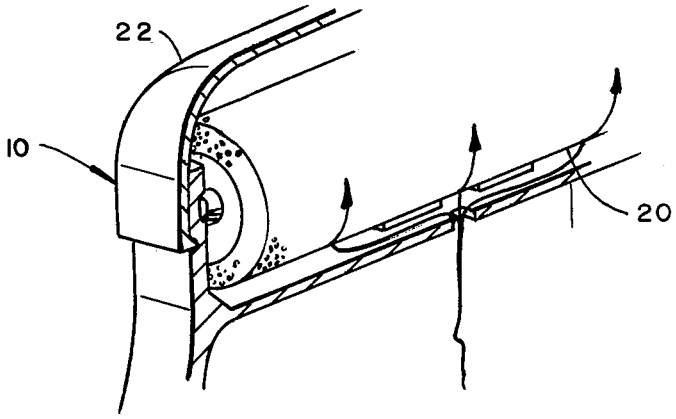
FIG. 3 is an enlarged partial assembled view of the applicator structure of the invention illustrating a roller and cover secured to the container of FIGS. 1 and 2, at the corner of the container illustrated 3 in FIG. 2.

The applicator structure for suntan lotion 10 of the invention as best shown in FIG. 3 includes a container 12 which may be constructed of, for example, a resinous plastic having a flexible portion 14 forming a chamber 16 for suntan lotion or the like and a rigid portion 18 for rotatably mounting a roller 20. A cover 22 is adapted to fit over the slot 24 in the container 12 with the roller 20 rotatably received therein and extending radially outwardly therefrom.

Figure 1:
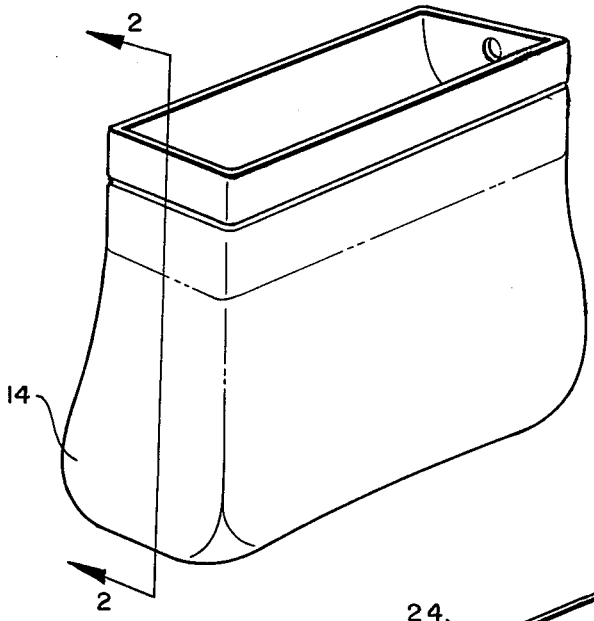
FIG. 1 is a perspective view of the container of the integral applicator structure of the invention.
Figure 2:
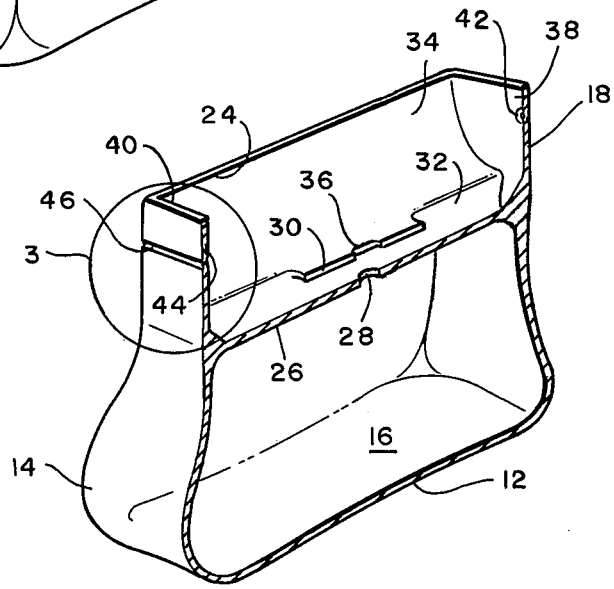
FIG. 2 is a perspective section view of the container illustrated in FIG. 1, taken substantially on the line 2—2 in FIG. 1.

More specifically, the container 12, as shown best in FIGS. 1 and 2, includes a first partition 26 forming one wall of and positioned between the chamber 16 and the slot 24 having a metering opening 28 located centrally thereof. A cosmetic such as suntan lotion may thus be metered through the opening 28 with the container in an inverted position so that the slot 24 faces downwardly.

The container 10 further includes the partition 30 extending across the central portion of a metering channel 32 formed in the container between opposed identical arcuate walls 34, as shown best in FIG. 2. The second partition 30 extends over substantially one-third the length of the metering channel 32 and includes an opening 36 located centrally thereof.

In use, suntan lotion is metered from the metering opening 28 through the metering channel 32 and onto the roller 20 in the slot 24 in surface to surface engagement with the walls 34 and the ends 38 and 40 of the slot 24. The lotion also feeds onto the roller 20 through the opening 36.

Spherical recesses 42 and 44 are provided in the end walls 38 and 40 of the slot 24 to rotatably mount the roller 20.

A peripheral groove 46 extends around the outer edge of the slot 24. The groove 42 releasably holds the cover 22 in place over the roller mounted in the slot 24.

Figure 5:
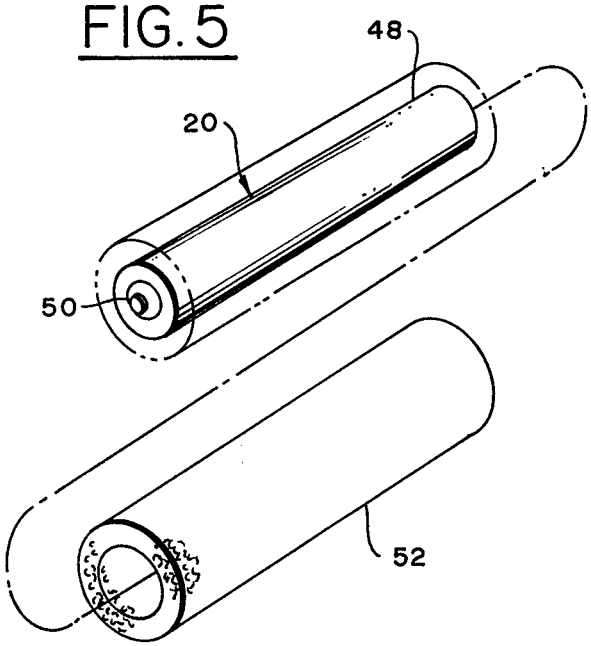
FIG. 5 is an exploded view of the roller of the applicator structure illustrated in FIGS. 1–4 showing the roller, core and cylinder disassembled and indicating in phantom the position of the cylinder sleeved over the core and the exploded positon of the core relative to the cylinder in phantom.

The roller 20, as best shown in FIG. 5, includes a core 48 which as shown is a solid cylinder of relatively rigid material such as a suitable plastic. The core 48 has a hemispherical bearing boss 50 on each end thereof adapted to fit within the hemispherical bearing recesses 42 and 44 in the container 12 to rotatably mount the roller 20 on the container 12.

The roller 20 further includes the hollow cylinder 52 adapted to fit snugly over the core 48 and to rotate therewith. The cylinder 52 is constructed to have a smaller inner diameter than the outer diameter of the core 20 and is constructed of a resilient material such as foam rubber or the like.

Further, the cylinder 52 is dimensional to have a diameter which is substantially the same as but slightly larger than the transverse dimension of the slot 24 and is dimensioned to have a longitudinal dimension slightly larger than the longitudinal dimension of the slot 40 so that the cylinder 52 is in some slight tension on the inner diameter thereof and in some slight compression on the outer diameter thereof within the container 12.

Figure 4:
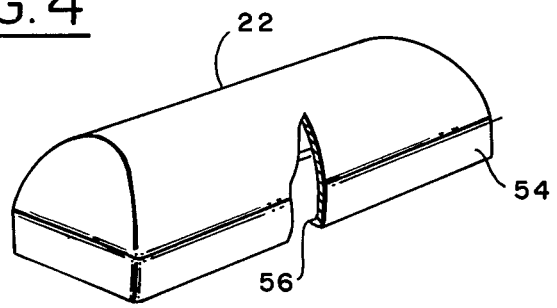
FIG. 4 is a broken perspective view of the cover for the container illustrated in FIGS. 1 and 2.

The cover 22, as shown best in FIG. 4, is an elongated bubble-like structure having the rectangular flange 54 extending about the four sides at the bottom thereof. An inwardly extending retaining lip 56 is provided on the cover 22 at the bottom of the flange 54. The lip 56 fits within the groove 46 on the container 12 to secure the cover 22 on the container 12 in assembly therewith.

In overall operation of the integral suntan lotion applicator structure 10 as described above, the applicator is manufactured with the lotion in the chamber 16 and with the roller and cover assembled thereon, as shown best in FIG. 3. With the cover 22 removed from the container 12 and the container 12 inverted slightly, pressure on the container 12 or gravity alone will cause suntan lotion in chamber 16 to pass through the opening 28 and into the metering channel 22 to be absorbed by the foam rubber cylinder 52 of the roller 20.

Thus, when the roller 20 is frictionally engaged with a body portion and the applicator is moved over the body portion, the suntan lotion will be evenly distributed over the body portion without contact of the body portion with an applicator's hands and thus without abrasive action.

It will be noted that due to the slight compression of the cylinder, the suntan lotion is retained in the container chamber 16 or in the metering channel 32. When the application of the suntan lotion has been completed, the cover 22 may be snapped back on the container 12 and the container safely carried for future use.

Other embodiments and modifications of the invention are contemplated. While specific configurations of the members of the applicator have been illustrated, and specific materials have been indicated, it will be understood that modifications and embodiments of the invention may be utilized in accordance with the invention. It is the intention to include all modifications and embodiments as are defined by the appended claims within the scope of the invention.

I claim as my invention is:

1. Applicator structure comprising a container including a chamber for a cosmetic such as suntan lotion, an elongated slot in the container, a roller rotatably mounted in and extending radially from the slot including a radially outer compressible portion and having a diameter extending across the width of the slot of slightly greater dimension than the width of the slot at the diameter of the roller means extending across the width of the slot whereby the roller means is under compression across the width of the slot and length substantially equal to the corresponding dimension of the slot, and means for directing the cosmetic from the chamber onto the roller over the greater portion of the surface thereof with the applicator inverted to place the roller lower than the container on rotating the roller in frictional engagement with a body portion.

2. Structure as set forth in claim 1, wherein the roller is of slightly greater dimension longitudinally of the roller than the longitudinal dimension of the slot and the roller includes longitudinally outer compressible portions.

3. Structure as set forth in claim 1, wherein the container is constructed at least in part of flexible material so as to permit squeezing thereof to place the contents of the chamber under pressure.

4. Structure as set forth in claim 1, wherein the container includes a first partition between the contents of the chamber and the roller having a centrally located opening therein, a metering channel extending longitudinally of the slot in communication with the opening in the first partition and a centrally located second partition between the first partition and the roller which has a second opening centrally thereof and which extends over substantially the central third of the length of the slot.

5. Structure as set forth in claim 4, wherein the container further includes arcuate walls extending from the longitudinal edges of the metering channel to the longitudinal edges of the slot having substantially the same radius of curvature as the roller.

6. Structure as set forth in claim 1, wherein the roller means is a two-part member having a substantially rigid cylindrical core and a resilient cosmetic absorbing hollow cylinder sleeved over the core.

7. Applicator structure comprising a container including a chamber for a cosmetic such as suntan lotion, an elongated slot in the container, a roller rotatably mounted in and extending radially away from the slot having a diameter and length substantially equal to the corresponding dimensions of the slot, and means for directing the cosmetic from the chamber onto the roller over the greater portion of the surface thereof with the applicator inverted to place the roller lower than the container on rotating the roller in frictional engagement with a body portion, including a first partition between the contents of the chamber and the roller having a centrally located opening therein, a metering channel extending longitudinally of the slot in communication with the opening in the first partition and a centrally located second partition between the first partition and the roller which has a second opening centrally thereof and which extends over substantially the central third of the length of the slot.

8. Structure as set forth in claim 7, wherein the container is constructed at least in part of flexible material so as to permit squeezing thereof to place the contents of the chamber under pressure.

9. Structure as set forth in claim 7, wherein the container further includes arcuate walls extending from the longitudinal edges of the metering channel to the longitudinal edges of the slot having substantially the same radius of curvature as the roller.

10. Structure as set forth in claim 7, wherein the roller is a two-part member having a substantially rigid cylindrical core and a resilient cosmetic absorbing hollow cylinder sleeved over the core.

11. Applicator structure comprising a container having a generally rectangular shape including a chamber for a cosmetic such as suntan lotion, which chamber is defined at least partly by a flexible material whereby the volume of the chamber may be varied by application of pressure to the flexible material, an elongated slot forming one side of the container, cylindrical roller means positioned within and extending radially outwardly of the container through said slot, which roller means is a two-part member having a substantially rigid cylindrical core and a resilient, cosmetic absorbent, hollow cylinder sleeved over the core, said roller means being of larger transverse dimension than the slot for at least a portion of the slot with the roller means positioned within the slot wherein the roller means is placed in radial compression over a portion of its circumference whereby the slot is sealed longitudinally except for material absorbed by the resilient cosmetic absorbing portion of the roller means, said resilient, cosmetic absorbent portion of the roller means also being of greater axial extent that the longitudinal dimension of the slot whereby the roller means is also placed under axial compression and the ends of the slot are sealed except for material absorbed by the roller means, said slot further including structure therein for directing a cosmetic from the chamber onto the roller means over the greater portion of the surface thereof with the applicator inverted to place the roller means lower than the chamber on rotating the roller means in frictional engagement with a body portion including a first partition in the container defining one wall of the chamber and positioned between the contents of the chamber and the roller having a centrally located opening therein, a metering channel extending longitudinally of the slot in communication with the opening in the first partition and a centrally located second partition between the first partition and the roller means which has a second opening centrally thereof and which extends over substantially the central third of the length of the slot, arcuate walls extending from the longitudinal edges of the metering channel to the longitudinal edges of the slot having substantially the same radius of curvature as the roller, hemispherical bearing bosses on the ends of the cylindrical core of the roller means and hemispherical recesses at the ends of the slot for receiving the bearing bosses to rotatably mount the roller on the container with the sleeve under radial and axial compression.

12. Applicator structure as set forth in claim 11, and further including an exterior peripheral groove about the sides of the container adjacent the slot and in close proximity thereto and a cover for the slot including an open side having a flange including a locking ridge thereon extending inwardly thereof completely around the periphery thereof adapted to fit within the peripheral groove on the container whereby the cover is held in place on the container on engagement of the locking ridge of the flange with the peripheral groove on the container.

* * * * *

UNITED STATES PATENT OFFICE

CERTIFICATE OF CORRECTION

Patent No. 4,129,391 Dated December 12, 1978

Inventor(s) Robert J. Gamache

It is certified that error appears in the above-identified patent and that said Letters Patent are hereby corrected as shown below:

On the cover sheet, the correct name of the inventor should be:

ROBERT J. GAMACHE

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*